United States Patent [19]

Schippers

[11] Patent Number: 4,519,203

[45] Date of Patent: May 28, 1985

[54] YARN TWISTING METHOD AND APPARATUS

[75] Inventor: Heinz Schippers, Remscheid-Lennep, Fed. Rep. of Germany

[73] Assignee: Barmag Barmer Maschinenfabrik AG, Remscheid, Fed. Rep. of Germany

[21] Appl. No.: 492,241

[22] Filed: May 6, 1983

[30] Foreign Application Priority Data

May 7, 1982 [DE] Fed. Rep. of Germany ..... 3217083

[51] Int. Cl.[3] ..... D01H 5/28; D02G 1/08

[52] U.S. Cl. ..... 57/328; 57/331; 57/339; 57/340; 57/348

[58] Field of Search ..... 57/328–331, 57/339, 340, 342

[56] References Cited

U.S. PATENT DOCUMENTS

| | | | |
|---|---|---|---|
| 4,003,194 | 1/1977 | Yamagata et al. | 57/328 |
| 4,339,915 | 7/1982 | Dammann et al. | 57/339 |
| 4,351,146 | 9/1982 | Faure et al. | 57/328 X |
| 4,387,487 | 6/1983 | Nakahara et al. | 57/328 X |
| 4,391,091 | 7/1983 | Lorenz | 57/340 |

*Primary Examiner*—John Petrakes

*Attorney, Agent, or Firm*—Bell, Seltzer, Park & Gibson

[57] ABSTRACT

A method and apparatus for twisting a yarn, such as a sliver of staple fibers, is disclosed, and wherein the yarn is advanced through a drafting zone and then through a twisting apparatus. The twisting apparatus includes two circular discs, with at least one of the discs being flexible. Also, in the preferred embodiment, two separate pressure applying members are mounted adjacent the back surface of the flexible disc, with the members being positioned on opposite sides of the plane defined by the axes of rotation of the discs. The two pressure applying members are adapted to be actuated concurrently, with one member defining a first twisting zone wherein S twist is imparted to the advancing yarn, and the other member defines a second twisting zone wherein Z twist is imparted. Means are also provided for controlling the degree of twist imparted at each of the zones, so as to obtain, for example, a twisted yarn composed of core fibers having minimal twist and which are bound by outer fibers of greater twist.

9 Claims, 3 Drawing Figures

YARN TWISTING METHOD AND APPARATUS

Figure 1:
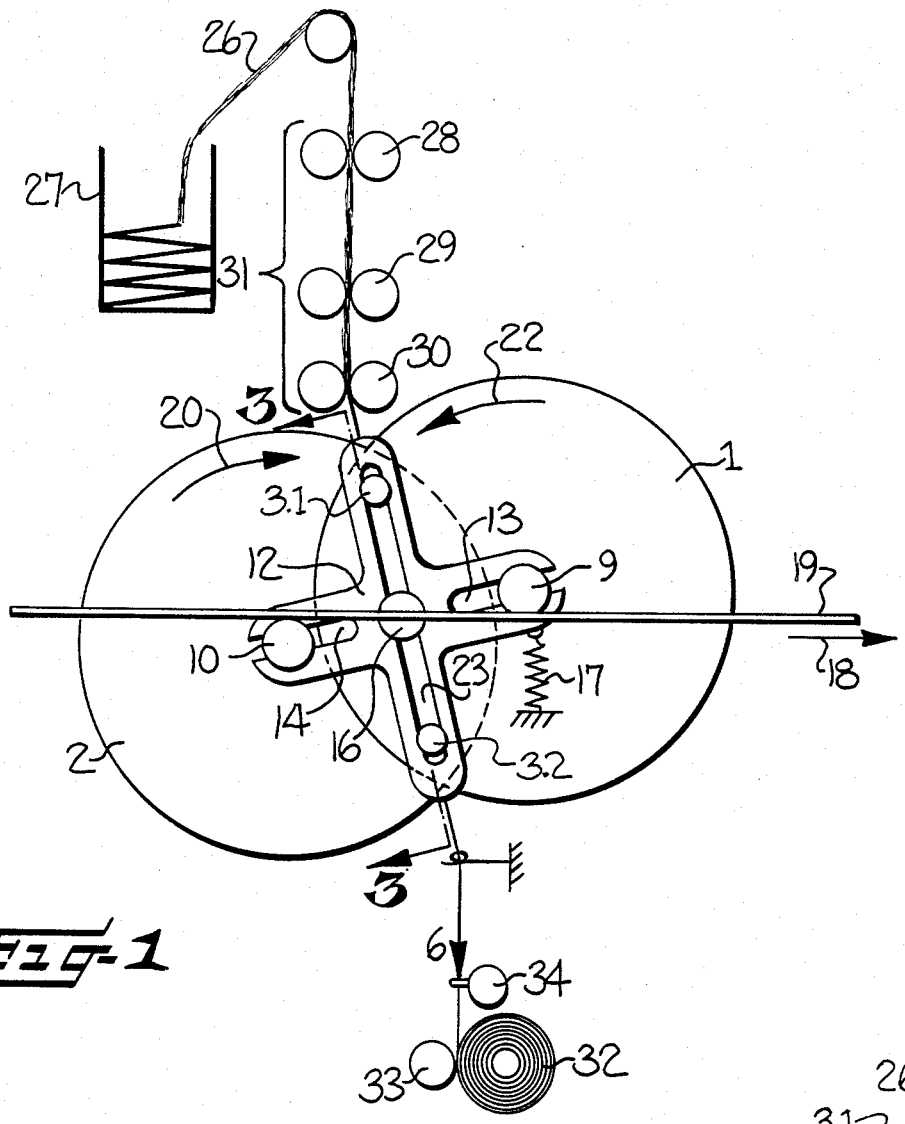

The present invention relates to a method and apparatus for twisting a yarn or sliver of staple filaments.

U.S. Pat. No. 4,339,915 to Dammann et al discloses an apparatus for false twisting a yarn which comprises a pair of rotatable discs mounted to define a twisting zone between opposing friction surfaces thereof. One of the discs is flexible, and can absorb relatively high tension forces, but will readily flex upon application of a lateral bending force. For the purpose of nipping a yarn, there is provided a pressure applying member adjacent the back face of the flexible disc for laterally biasing the flexible disc toward the other disc locally at the twisting zone. Thus the two discs contact and nip the yarn only in a very limited area, which is defined by the pressure applying member. The other disc of the pair may also be flexible, in which case a second pressure applying member may be mounted adjacent the back face of the other disc and in alignment with the first pressure applying member. Alternatively, the other disc may be relatively rigid and non flexible, In each of these arrangements, the false twisting operation not only twists the yarn, but it also conveys the yarn longitudinally along its path of travel.

U.S. pending application Ser. No. 273,196 to Lorenz, now U.S. Pat. No. 4,391,091, discloses a similar false twisting apparatus which includes two separate pressure applying members disposed on respective opposite sides of the plane defined by the axes of rotation of the discs, with the two pressure applying members being alternately actuated to selectively apply either S or Z twist to the yarn.

In accordance with the present invention, there is provided a yarn twisting apparatus of the type generally described above, but which has the capability of producing effect yarns and/or spun yarns. In the preferred embodiment, the apparatus of the present invention includes a pair of rotatable discs, at least one of which is flexible, and a pair of pressure applying members disposed on the same side of the flexible disc and respectively above and below the plane defined by the axes of rotation of the discs. Upon alternate actuation of the members, an effect yarn may be produced which exhibits segments with an S twist alternately arranged with segments of Z twist. In addition, the two pressure applying members may be operated concurrently and continuously, to provide false twist textured torque free continuous filament yarns, or twisted spun yarns. In one case, the apparatus may form a part of a false twist texturing machine for synthetic filaments, or it may be mounted downstream of a conventional drafting system in which a sliver consisting of pre-drawn spun fibers is first drafted to the desired density of the yarn to be spun, and then guided between the front faces of the two rotating discs and through the two twisting zones. In this process, the yarn, or the sliver, receives a twist in one direction in the area of the first pressure applying member and a twisting in the other direction in the area of the second pressure applying member. Thus, a crimped synthetic filament yarn may be produced, whose inherent tendency to torque is substantially eliminated by the second twist, or alternatively, a spun yarn may be produced having slightly twisted core fibers which are bound by more twisted outer fibers.

The above texturing or twisting process may be controlled by varying the speed of the two rotating discs.

However, according to the invention, it can also be controlled by separately and differently adjusting the contact pressures of the first and second pressure applying members. Further, it is possible to vary the distances of the pressure applying members from the plane defined by the axes of rotation, so as to control the twisting effect. In doing so, a different ratio of yarn twist to yarn conveyance is achieved.

Figure 2:
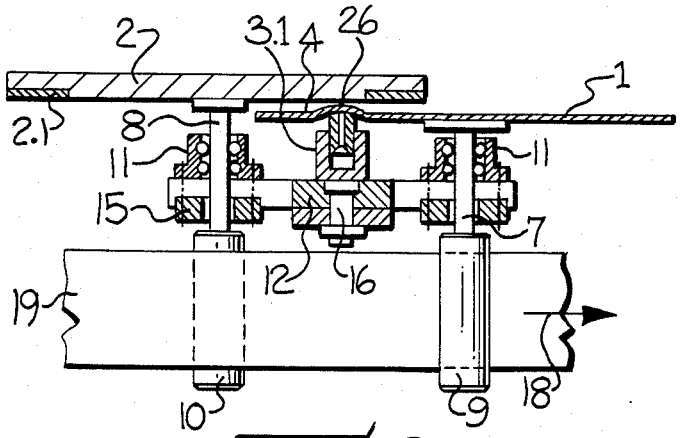
Figure 3:
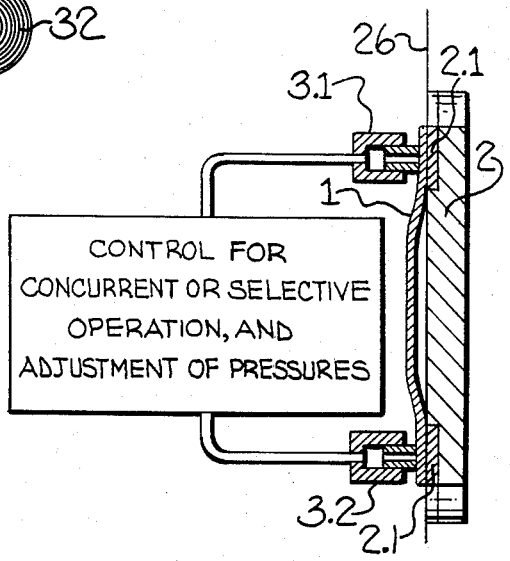

Some of the objects and advantages of the invention having been stated, others will appear as the description proceeds, when taken in connection with the accompanying schematic drawings, in which FIG. 1 is a front elevation view of a yarn twisting apparatus embodying the features of the present invention;

FIG. 2 is a sectional plan view of the apparatus shown in FIG. 1 taken in a direction perpendicular to the plane defined by the axes of the two discs; and FIG. 3 is a sectional side elevation view taken substantially along the line 3—3 of FIG. 1.

Referring more particularly to the drawings, there is schematically illustrated a yarn twisting apparatus which is adapted for use in false twist machines for texturing synthetic filament yarns. As illustrated, the twisting apparatus comprises two discs 1 and 2, with the disc 1 being composed of a relatively thin and flexible material, such as an elastomeric material having a thin metallic reinforcing sheet imbedded therein. As such, the disc 1 is capable of absorbing high tension forces in the radial direction, but is readily flexible in the lateral direction. The disc 2 may also be composed of a flexible material, but in the illustrated embodiment, the disc 2 is rigid and its front face is provided with a friction coating 2.1 having friction properties similar to that of the disc 1.

The two circular discs are mounted for rotation about respective spaced apart substantially parallel axes and such that portions of the respective yarn engaging friction surfaces are disposed in opposing, face to face relationship. A pair of pressure applying members 3.1 and 3.2 are also provided. The pressure applying members may be of the structure specifically disclosed in U.S. Pat. No. 4,339,915, and each member is operatively positioned adjacent the face of the flexible disc 1 opposite its yarn engaging friction surface. The member 3.1 is located at a point laterally spaced on one side of the plane defined by the axes of rotation, and the other member 3.2 is located at a point laterally spaced on the other side of such plane. Thus the two members define separate first and second separate twisting zones, wherein the flexible disc 1 is biased toward the rigid disc 2. A yarn or draw frame sliver which is advanced between the surfaces of the discs 1 and 2, and serially between the two twisting zones, will be conveyed by the force components imparted by the discs in the direction of arrow 6, and twisted in opposite directions.

The discs 1 and 2 are respectively mounted on two drive shafts 7 and 8, which carry drive whorls 9 and 10 respectively at their projecting ends. The drive shafts 7 and 8 are supported in the usual anti-friction bearings 11, which in turn are mounted on the bracket 12. The bearings 11 may be adjustably positioned along the guide slots 13 and 14 in accordance with the desired twist conditions, and they may be clamped or held in place in the slots by suitable fastening means 15.

Bracket 12 for mounting the discs 1 and 2 is attached to the machine frame by an arrangement which includes a pivot pin 16 which projects from the frame, and the bracket may be secured against an undesired axial displacement by a snap or clip lock or the like which is associated with the pin 16. The bracket 12 is also adapted to rotate on the pin 16 in a plane parallel to the machine front, and at least one biasing member, such as the tension spring 17, is supported between the machine frame and the bracket 12 to bias the bracket so that the whorls of the discs 1 and 2 are held against an endless tangential belt 19 which travels in a horizontal plane on the machine in the direction of arrow 18. Thus the whorls 9 and 10 are pressed against the tangential belt 19 and are driven essentially without slippage. As shown in FIG. 1, the whorl 9 contacts the belt 19 on the top thereof, and the whorl 10 contacts the bottom of the belt, so that the friction discs are rotated in the direction of arrows 20 and 22. Also, the yarn or sliver receives a Z twist at the upper twisting zone, and the twist backs up from the twisting zone in the yarn or sliver.

As best seen in FIG. 3, the yarn or draw frame sliver is nipped in the area of the two pressure applying members 3.1 and 3.2, and thus receives first a twist in one direction and then a twist in the other direction. The two applied twisting forces result in twist of one direction being applied upstream of the first member 3.1 and twist of the opposite direction being applied between the first member 3.1 and second member 3.2. The members 3.1 and 3.2 may be displaced along the guide slot 23, and be secured on the bracket 12 after having been adjusted to a desired operating position. This adjustment permits the ratio of twist insertion and yarn conveyance for both twisting zones to be adjusted.

To change the direction of twist of the apparatus, the invention provides that the mounting of the bearing housings on bracket 12 may be loosened, and that the discs 1 and 2, including the drive shafts 7, 8, whorls 9, 10 and bearings 11 may be laterally removed from the guide slots 13, 14 of the bracket 12, and interchanged, readjusted, and secured in place. Following this procedure, the whorl 9 of disc 1 will contact the tangential belt 19 from the bottom, so that this disc rotates in the opposite direction. The same applies to disc 2, with the whorl 10 then being positioned above the belt 19. The draw frame sliver or yarn then receives an S twist at the upper twisting zone as seen in FIG. 1. In this regard, it should be noted that there is no need to change the position of the pressure applying members 3.1 and 3.2, since the bracket 12 and guide slots 13 and 14, are constructed symmetrically.

As an alternative to the above procedure for changing the twist direction, the entire bracket 12 may be axially moved along the pin 16, so that the whorls 9, 10 may be pivoted past the belt 19. The bracket 12 may then be rotated by 180 degrees to a new position, where it may again be axially moved back so as to contact the tangential belt 19, with the biasing means 17 again operatively contacting the bracket 12. This procedures requires that the pressure applying members be disconnected and remounted to the other side of the pivot pin.

As still another embodiment, a change from Z to S twist or vice versa may be effected by a mounting arrangement for the discs 1 and 2 such that the discs may be axially displaced on the drive shafts 7 and 8, with their position with respect to the yarn path thus being interchanged. This arrangement is preferred when both friction discs 1 and 2 are made from the same flexible material, and when each of them is locally biased by a respectively associated pressure applying member 3.1 and 3.2, so as to nip the yarn or the sliver between the friction surfaces. In this case, a pair of pressure applying members may be aligned with each other at each of the two twisting zones, with each pair being jointly adjustable along the guide slot 23 in the bracket 12. It should also be noted that the guide slot 23 extends along the perpendicular bisector of a line connecting the centers of the discs 1 and 2, or is parallel to such bisector.

The pressure applying members 3.1 and 3.2 may be adjustably attached directly to the machine frame, so as to be essentially independent of the bracket 12. Thus the members remain in their fixed position when the bracket is rotated, and they need not be displaced or repositioned along the guide slot 23.

In accordance with the present invention, and as shown in FIG. 1, the twist apparatus may be used to twist a yarn of spun staple fibers. To this effect, a draw frame sliver 26 is withdrawn from a can 27 by cooperating pairs of rolls 28,29, 30 of a drafting system 31. The yarn is thereby drawn to a desired density of the yarn to be spun. Subsequently, the yarn advances through the first twisting zone defined by the member 3.1, and then serially through the second twisting zone defined by the member 3.2. As it does so, the yarn receives a Z twist between the last pair of rolls 30 and the first twisting zone, and an oppositely directed S twist is imparted at the second twisting zone. Upon leaving the twist apparatus, the yarn is wound onto a package 32 by means of a traverse motion device 34. Also, the package 32 is illustrated as being rotated by a surface drive roll 33.

The above described apparatus may be utilized to produce a variety of yarn constructions. For example, a staple fiber yarn or sliver may be twisted by advancing the yarn between the discs while actuating both of the pressure applying members, and so that some of the fiber ends are loosened in the first twisting zone, and the loosened fiber ends are oppositely twisted to a greater degree in the second twisting zone. The resulting yarn is composed of core fibers of minimal twist, and which are bound by outer fibers of greater twist.

The apparatus is also useful in an open end spinning operation, wherein twist may be imparted to the yarn at a point immediately downstream of the rotor. In this case, it may be desirable that only one of the pressure applying members be operative, so that twist is imparted in only one direction.

That which is claimed is:

1. A method of twisting a yarn sliver composed of staple fibers, and comprising the steps of providing a pair of twist imparting circular discs, with each disc including a yarn engaging friction surface, and with at least one of said discs being relatively thin and flexible, and with said discs being mounted for rotation about parallel spaced apart axes and such that portions of the respective yarn engaging friction surfaces are disposed in opposing, face to face relationship, providing a first pressure applying member positioned intermediate said axes of rotation of said discs and on one side of the plane defined by such axes of rotation, and so as to locally bias said one flexible disc toward the other disc and thereby define a first twisting zone, providing a second pressure applying member positioned intermediate said axes of rotation and on the side of the plane defined by such axes opposite said first pressure applying member, and so as to locally bias said one flexible disc toward the other disc and thereby define a second twisting zone, rotating each of said discs in opposite directions about their respective axes, while advancing the yarn sliver along a path of travel and including drafting the advancing sliver to obtain a desired density and then advancing the drafted sliver serially through said two twisting zones in a direction perpendicular to the plane defined by the axes of rotation of said discs so as to have twist imparted thereto at each of said twisting zones by frictional contact between the yarn sliver and the respective opposed friction surfaces resulting from the force exerted by said pressure applying member at each twisting zone, and controlling the actuation of said first and second pressure applying members to apply opposite twisting forces to the advancing yarn sliver, with such twisting forces applying twist of one direction upstream of the first pressure applying member and applying twist of the opposite direction between the first and second members.

2. A method of twisting a yarn and comprising the steps of providing a pair of twist imparting circular discs, with each disc including a yarn engaging friction surface, and with at least one of said discs being relatively thin and flexible, and with said discs being mounted for rotation about parallel spaced apart axes and such that portions of the respective yarn engaging friction surfaces are disposed in opposing, face to face relationship, providing a first pressure applying member, with said first pressure applying member being positioned intermediate said axes of rotation of said discs and on one side of the plane defined by such axes of rotation, and so as to locally bias said one flexible disc toward the other disc and thereby define a first twisting zone, providing a second pressure applying member, with said second member being positioned intermediate said axes of rotation and on the other side of the plane defined by such axes, and so as to locally bias said one flexible disc toward the other disc and thereby define a second twisting zone, adjusting the biasing force of each of the first and second pressure applying members so as to impart a predetermined biasing force at each of said twisting zones, rotating each of said discs in opposite directions about their respective axes, while advancing a yarn along a path of travel so as to move serially through said first and second twisting zones with S twist being imparted at one of the zones and Z twist being concurrently imparted at the other of the zones, and with the degree of twist imparted at each of said twisting zones being determined by the adjustment of the biasing force.

3. The method as defined in claim 2 wherein the yarn comprises staple fibers and the step of advancing a yarn along a path of travel includes drafting the yarn at a location immediately upstream of the circular discs to obtain a desired yarn density.

4. The method as defined in claim 2 or 3 wherein the biasing forces of the two pressure applying members are adjusted so as to apply different biasing forces to said flexible disc.

5. The method as defined in claim 2 or 3 wherein the two pressure applying members are located different distances from the plane defined by the axes of rotation.

6. A yarn twisting apparatus comprising yarn drafting means for reducing the density of a yarn passing therethrough, a pair of twist imparting circular discs, with each disc including a yarn engaging friction surface, and at least one of said discs being flexible, means rotatably mounting said circular discs at a location immediately downstream of said drafting means and for rotation about respective spaced apart substantially parallel axes and such that portions of the respective yarn engaging friction surfaces are disposed in opposing, face to face relationship and define a first twisting zone therebetween which is located at a point laterally spaced on one side of the plane defined by the axes of rotation and a second twisting zone therebetween which is located at a point laterally spaced on the other side of said plane, drive means for operatively rotating each of said circular discs in opposite directions about their respective axes, a first pressure applying member operatively positioned adjacent the face of said flexible disc opposite its yarn engaging friction surface and aligned with said first twisting zone, to bias said discs toward each other locally at said first twisting zone and such that a yarn may be advanced through said drafting means and then immediately through said first twisting zone while having twist imparted thereto by frictional contact between the yarn and the respective opposed friction surfaces, a second pressure applying member positioned adjacent the face of said flexible disc opposite its yarn engaging friction surface and aligned with said second twisting zone, to bias said discs toward each other locally at said second twisting zone such that a yarn may be advanced from said first twisting zone and through said second twisting zone while having twist imparted thereto in a direction opposite to that imparted at said first twisting zone, and control means for actuating said first and second pressure applying members to apply twist at either one of said twisting zones, or at both of said zones.

7. A yarn twisting apparatus comprising a pair of twist imparting circular discs, with each disc including a yarn engaging friction surface, and at least one of said discs being flexible, means rotatably mounting said circular discs for rotation about respective spaced apart substantially parallel axes and such that portions of the respective yarn engaging friction surfaces are disposed in opposing, face to face relationship and define a first twisting zone therebetween which is located at a point laterally spaced on one side of the plane defined by the axes of rotation, and a second twisting zone therebetween which is located at a point laterally spaced on the other side of said plane, drive means for operatively rotating each of said circular discs in opposite directions about their respective axes, a pair of pressure applying members, with said members each being operatively positioned adjacent the face of said flexible disc opposite its yarn engaging friction surface, with one member aligned with said first twisting zone and the other member aligned with said second twisting zone, and means for concurrently actuating both of said pressure applying members so as to bias said discs toward each other locally at each of said twisting zones and such that a yarn may be serially advanced through said first and second twisting zones while having S twist imparted at one of the zones and Z twist concurrently imparted at the other of the zones, and including means for adjusting the biasing forces of the two members relative to each other.

8. The apparatus as defined in claim 7 further comprising means mounted immediately upstream of said circular discs for drafting an advancing yarn to obtain a desired yarn density prior to advancing through said twisting zones.

9. The apparatus as defined in claim 7 or 8 further comprising means mounting said pair of pressure applying members for relative movement toward or away from each other and so that they may be located different distances from the plane defined by the axes of rotation.

* * * * *